United States Patent [19]

Cooper et al.

[11] 4,069,633

[45] Jan. 24, 1978

[54] REFRACTORY WALL STRUCTURES

[75] Inventors: Charles Frank Cooper, Stourport on Severn; Robert Greer, Appleton, both of England

[73] Assignee: Morgan Refractories Limited, England

[21] Appl. No.: 678,234

[22] Filed: Apr. 19, 1976

Related U.S. Application Data

[63] Continuation of Ser. No. 529,243, Dec. 3, 1974, abandoned.

[30] Foreign Application Priority Data

Dec. 4, 1973 United Kingdom ..... 56173/73

[51] Int. Cl.[2] ..... E04C 1/10

[52] U.S. Cl. ..... 52/586; 266/283; 52/596

[58] Field of Search ..... 52/586, 596, 510, 437, 52/232, 483; 65/26; 110/1 A; 266/280, 281, 283, 285

[56] References Cited

U.S. PATENT DOCUMENTS

| | | | |
|---|---|---|---|
| 991,805 | 5/1911 | Selden | 110/1 A |
| 1,606,150 | 11/1926 | Curtis | 52/483 |
| 2,223,400 | 12/1940 | Bigelow | 110/1 A |
| 2,269,445 | 1/1942 | Easter | 52/510 |
| 2,411,477 | 11/1946 | Straight | 52/586 |
| 2,467,069 | 4/1949 | Wright | 110/1 A |

FOREIGN PATENT DOCUMENTS

| | | | |
|---|---|---|---|
| 254,646 | 5/1963 | Australia | 52/596 |
| 644,682 | 8/1937 | Germany. | |
| 829,301 | 1/1952 | Germany. | |
| 897,614 | 11/1953 | Germany. | |
| 20,076 of | 1906 | United Kingdom | 52/437 |

*Primary Examiner*—James L. Ridgill, Jr.
*Attorney, Agent, or Firm*—Larson, Taylor and Hinds

[57] ABSTRACT

A refractory furnace lining or like wall structure is built as a dry wall from unfired, relatively large and heavy, basically rectangular blocks fitted closely together and tied by refractory rod-like keys in opposed pairs of grooves in the blocks. A wall built of such blocks is fired in situ.

5 Claims, 4 Drawing Figures

REFRACTORY WALL STRUCTURES

Figure 1:
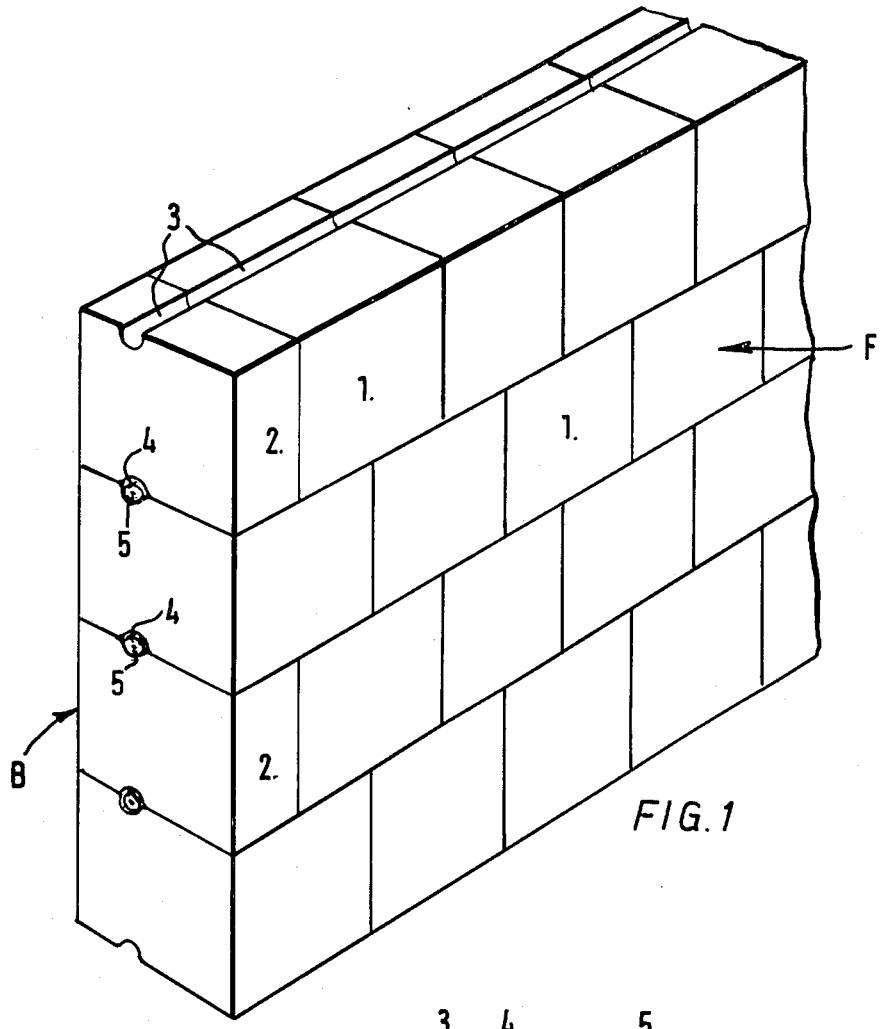

This is a continuation of application Ser. No. 529,243 filed Dec. 3, 1974 now abandoned.

This invention relates to refractory wall structures, especially linings for the walls or ceilings of furnaces, such as metal treatment or re-heat furnaces, or linings for soaking pits used in the steel industry.

Such refractory linings are built as free-standing walls, or anchored ceilings, so as to be separated, for thermal insulation, from the outer furnace or soaking pit structure and, except for anchorages or ties, the linings must be self-supporting and stable to withstand severe thermal and mechanical stresses.

The front, working face of such a lining may be exposed to a temperature of about 1500° C while, depending on the thermal conductivity and thickness, the back face has a substantially lower temperature, down to about 800° C. Such a wide temperature difference can produce uneven expansion or contraction causing bowing, arching or other deformation of the wall structure.

To oppose such deformation, it has been the practice to anchor or tie refractory linings at closely spaced points to the furnace or pit structure and to build them as walls from refractory bricks or blocks using refractory mortar as a vital means of ensuring stability of the wall structure.

To build such a wall of bricks or blocks and mortar requires great skill and considerable time with high resultant cost for repair or rebuilding during which the plant is not in production.

Lining walls in re-heat furnaces and soaking pits are liable to heavy mechanical shock, from impact by heavy slabs or billets or metal under treatment, and this can cause cracking of mortar and displacement of bricks.

There have been proposals to build furnace linings or other refractory wall structures from blocks specially shaped to fit together, without mortar, and to interlock or be held in place by tie rods or other means. No such structure has yet superseded the bricks and refractory mortar construction in general use.

The present invention provides a refractory wall structure built of refractory blocks and keys, as a dry wall, and it is based on identification of the factors involved in the building and working conditions of the wall structure and combination of means to suit these factors.

The invention therefore comprises the following features in combination;

a. the blocks are pre-formed from refractory material and dried, but not fired, so that they have enough strength for transportation and building, such as a minimum crushing strength of 100 Kg per $cm^2$, b. the weight of each full-size block is as high as is convenient, according to the particular wall structure, for manipulation by one operative, in particular 13 to 50 Kg., c. the basic outline shape of the blocks is rectangular, d. the wall structure consists of blocks laid in mutual contact in horizontal courses bonded by overlapping of blocks in successive courses, e. the upper and lower faces of the blocks have complementary grooves which are mutually opposed in pairs between successive courses to form conjointly tubular key-ways extending along the courses and within the wall, f. rod-like keys of fired refractory material extend through the key-ways with a clearance but occupying respective pairs of opposed grooves sufficiently to lock the blocks against sliding out of the plane of the wall.

Consideration of the above features shows that the invention embodies the following corresponding technical advantages;

a. the blocks, being pre-formed but not fired, are not distorted and can be fitted closely together without mortar, b. relatively heavy blocks are correspondingly large so that fewer blocks are required for any given wall, an operative can however lift the blocks singly and slide them into place but their inertia is high so that they are not easily displaced, c. rectangular blocks fit together without gaps, d. an overlapping bond is a well-established stable wall structure, e. grooves are easily formed in block surfaces, and do not involve local weakness as compared with bores or interlocking recesses and projections, f. rod-like keys are simple to make, being fired they can safely be handled without breaking easily, having a clearance in the key-ways they do not impose a requirement for strict alignment of the grooves, which permits the wall to be built to achieve an even front face as the principal datum, and their strength as keys is high in transverse compressive stress between opposed pairs of grooves.

After the refractory wall structure as described above has been completed, on initial building, rebuilding or repair as required, the refractory blocks become fired in situ when the plant is first heated for use and the whole structure is thus subjected to the same firing conditions.

The features that the blocks are unfired, large and closely fitted together, so as to present a continuous front surface, contribute to a very important technical advantage when the wall is fired in situ. The front face of the wall is exposed to the full furnace heat, for example 1500° C, and the material of the blocks at the face becomes fired to a vitreous state which is dense, hard and highly refractory but relatively brittle. Having low thermal conductivity, the material of the blocks is subjected to progressively less intense heat through the thickness of the wall away from the front face. Consequently, the degree of vitrification reduces with the downward temperature gradient and towards the back of the wall, where the temperature is only about 800° C for example, the material of the blocks has a lower modulus of elasticity and is more capable of withstanding thermal and mechanical shock. In simple terms, the wall fired in situ has a highly refractory front face and is relatively tough and more shock-proof, progressively towards the back.

To meet requirements for anchorages or ties for wall linings or suspension anchorages for ceilings for example, special blocks may be incorporated in the walls at anchorage points or recesses may be provided for anchorages to be secured with mortar. Such anchorage points are widely spaced and do not affect the general dry wall principle of construction.

Blocks from which such a wall can be built in themselves constitute features of the invention and in particular there are two specific embodiments thereof.

A simple but very effective block in accordance with the invention is of plain rectangular shape, which may be cubical or elongated, and in the upper face and the lower face of the block a substantially semi-circular section groove is formed, each groove extending across the full width of the block and preferably nearer the back face than the front face so that, when built into a wall, it is away from rather than towards the wall face exposed to heat. Also, as blocks are cast or moulded with their eventual back faces uppermost, the back faces are relatively rough. Offset grooves ensure correct installation with the better faces of the blocks at the front of the wall.

Such blocks will usually be made in two sizes, for each type, comprising full-size blocks and half-width blocks, known as "bonders", so that walls can be built with bonded courses.

In the upper and lower face runs of each course, the grooves of the blocks are aligned and in the upper groove of each course, except the top course, is laid a key consisting of a fired refractory rod, for example an extruded tubular rod of fireclay, which rests with a clearance in the groove but projects above it by a substantial part of the thickness of the key. Each key is covered by the aligned grooves in the lower faces of the blocks of the next upper course so that the keys lie in tubular key-ways, formed by opposed pairs of grooves, extending horizontally along the wall between the courses.

In any one key-way, two or more keys of convenient length may be laid end to end so that each block is locked, by transverse abutment of keys in its grooves, against sliding out of the plane of the wall.

Another form of block provided by the invention is shaped so that, when built into a wall, it gravitates into interlock with adjacent blocks. The essential characteristic of the shape of this block is that it has, in two opposite faces, which are the upper and lower faces in use, a waisted recess between two co-planar borders, each recess having a central plane base parallel to and of width slightly greater than the sum of the border widths and symmetrical sloping sides leading from the base to the borders respectively, the angle of slope of the waist sides being not less than 10° and preferably between 20° and 45°.

Preferably the waisted faces of the blocks are symmetrical, so that their plane borders are of equal width, but this is not essential.

The important technical advantage of the waisted shape of block is that similar blocks will gravitationally nest together when built into a wall or like structure, an upwardly-directed waist of one block receiving, as a conjoint fit closely side-by-side, the adjacent border portions of two superposed similar blocks.

Being of substantial weight, for example 13 – 50 Kg, the blocks tend to slide down into place, their border portions gently settling into the waists of the blocks below, and a dry wall of the blocks is very stable without the need for mortar. The weight of the blocks is not critical but the range 13–50 Kg is preferred.

The waisted blocks also have grooves across their waisted faces, to form key-ways for rod-like keys when they are built into a wall, as described above for simple rectangular blocks.

A suitable material for the refractory blocks is an alumino-silicate, castable, mouldable or ramming material, preferably having a minimum of 34% alumina content and a dried crushing strength of not less than 105 Kg per $cm^2$. Basic refractory materials could be used. Such blocks are of adequate strength for transportation and building. In use the blocks become fired in situ.

Figure 2:
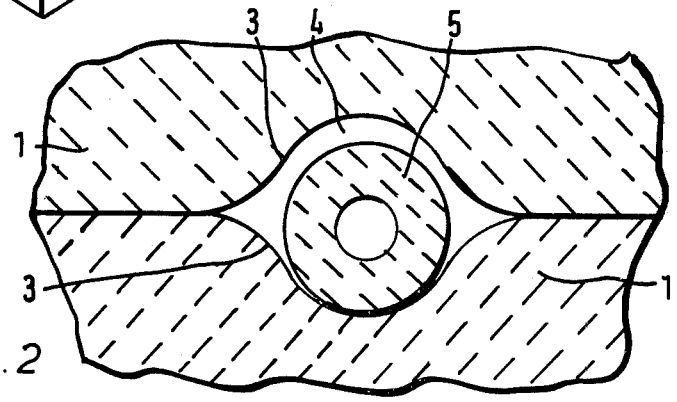
Figure 3:
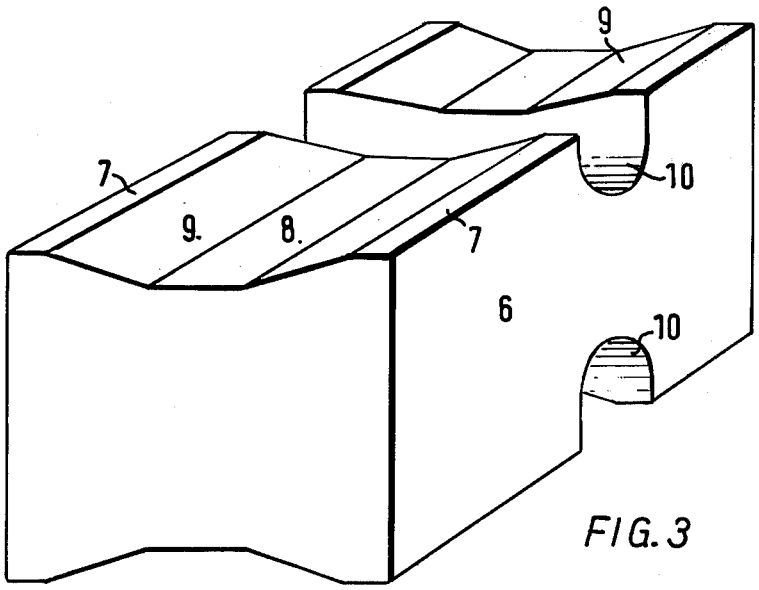
Figure 4:
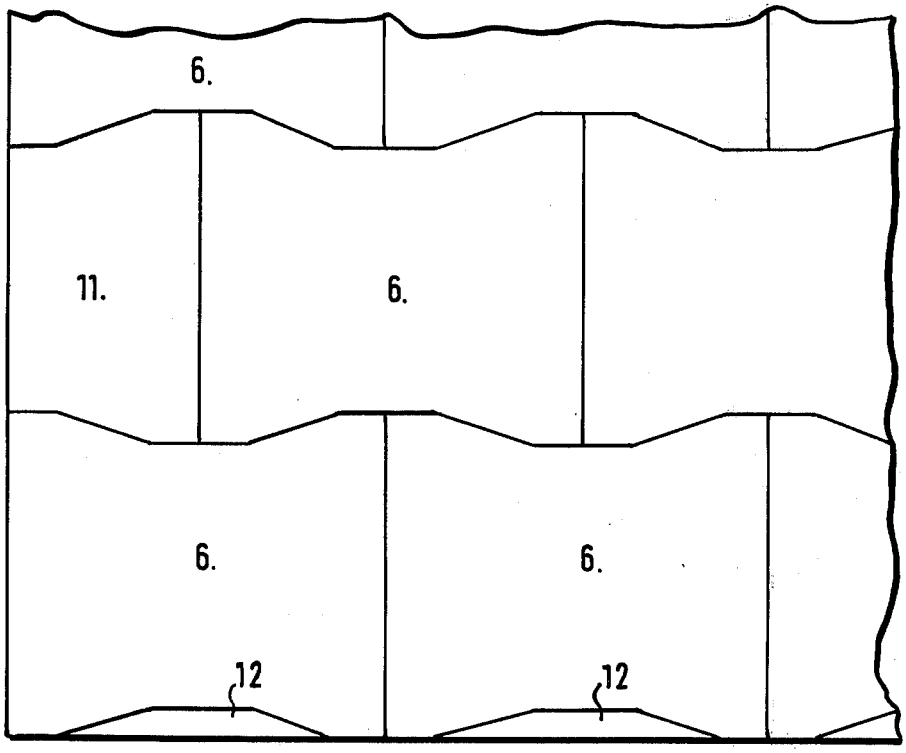

The invention is illustrated, by way of example, on the accompanying drawings, in which:

FIG. 1 is a fragmentary perspective view of a wall built with rectangular blocks and keys according to the invention, FIG. 2 is a fragmentary section, on a larger scale, showing a tubular rod key in its key-way between two blocks, FIG. 3 is a perspective view of a waisted and grooved block according to the invention, and FIG. 4 is a fragmentary front elevation of a wall built from blocks as shown by FIG. 3.

As shown by FIG. 1, rectangular full-size blocks 1 and half-size bonders 2 are built into a wall so that grooves 3 across the width of the upper and lower faces of the blocks are aligned and conjointly form key-ways 4 (FIG. 2) for tubular rod keys 5 laid in the grooves of each lower course. The grooves 3 are offset, nearer the block faces of the back B of the wall than the front F.

The keys have a clearance in their grooves, so as not to bind therein and permit, if desired, axial insertion or removal of keys from the key-ways. The projection of each key into the upper groove of its key-way is sufficient to form a positive abutment, which is strong in compression, against sliding of the blocks out of the plane of the wall.

The grooves and keys could be of other cross-sectional shape, for example square or hexagonal.

The waisted block 6 of FIG. 3 has, on each of its upper and lower faces, two co-planar borders 7 of equal width and a central plane base 8, of slightly more than twice the borders width, with gently sloping sides 9. Across the width of the upper and the lower face a groove 10 is provided corresponding to the grooves 3.

The waisted blocks 6 can be built into a wall (FIG. 4) with a symmetrical overlapping bond so that each lower block conjointly receives the adjacent borders of two superposed blocks, except at the ends of courses where half-size bonders 11 are used. Below the bottom course, closing tiles 12 are provided to fill the waists. Alternatively or in addition the bottom course may be set in a refractory mortar foundation.

The present invention provides a dry wall capable of maintaining its stability even under extreme stress caused by differential contraction or expansion, which can withstand severe mechanical shock, and does not require an excessive number of anchorage points.

As a practical guide to suitable dimensions for the full-size blocks in accordance with the invention, it may be stated that an alumina-silicate block having a dried weight of 44 Kg may be made of square cross-section 23 × 23 cm. and 38 cm. thickness, from front face to back face.

We claim:

1. A refractory wall structure built of refractory blocks and keys as a dry wall and comprising, in combination:

a. a plurality of blocks of pre-formed refractory material, said pre-formed refractory material being dried but not fired and having sufficient strength for transportation and building, said blocks being rectangular in basic outline shape and having as high a weight as is convenient for manipulation by one operative;

b. said blocks being arranged in a wall structure in which the blocks are laid in mutual contact in a plurality of horizontal courses with overlapping of blocks in vertically successive horizontal courses and with the blocks of each upper course resting on the blocks of the next lower course;

c. the upper and lower faces of the blocks having complementary grooves within said faces, said grooves being mutually opposed between said vertically successive horizontal courses to form, conjointly, a horizontal tubular key-way extending along and within the wall between each of said plurality of vertically successive horizontal courses;

d. a plurality of discrete rod-like keys of fired refractory material extending end to end horizontally through each of said tubular key-ways with a clearance but occupying respective mutually opposed grooves of adjacent blocks sufficiently to lock the respective blocks against sliding out of the plane of the wall, said keys being elongate and extending across a plurality of blocks in each course and resting with a clearance in the groove in the upper faces of the blocks of a respective lower course but projecting above said groove into the complementary groove in the lower face of the blocks of a respective upper course by a substantial part of the thickness of the keys.

2. A refractory wall structure according to claim 1 wherein said blocks have low thermal conductivity.

3. A refractory wall structure according to claim 1, in which the grooves are offset, nearer the faces of the blocks at the back of the wall than the front.

4. A refractory wall structure according to claim 3, in which the blocks are of plain rectangular shape.

5. A refractory wall structure according to claim 3, in which full-size blocks, of basic rectangular outline shape, each have in the upper and lower faces a waisted recess between two co-planar borders, each recess has a central plane base parallel to and of a width slightly greater than the sum of the border widths, and symmetrical sloping sides leading from the base to the borders respectively, the angle of slope being between 10° and 45°.

* * * * *